US011453954B2

(12) United States Patent
Mintzer, III et al.

(10) Patent No.: US 11,453,954 B2
(45) Date of Patent: Sep. 27, 2022

(54) MASKING AND SEALING SYSTEM FOR MULTI-STEP SURFACE TREATMENT

(71) Applicant: HONEYWELL INTERNATIONAL INC., Charlotte, NC (US)

(72) Inventors: Joseph William Mintzer, III, Phoenix, AZ (US); James Piascik, Randolph, NJ (US); Glenn Sklar, Randolph, NJ (US); Nicola Amatangelo, Chandler, AZ (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 15 days.

(21) Appl. No.: 17/064,703

(22) Filed: Oct. 7, 2020

(65) Prior Publication Data

US 2022/0106699 A1 Apr. 7, 2022

(51) Int. Cl.

| | |
|---|---|
| ***C25D 17/00*** | (2006.01) |
| ***C25D 17/12*** | (2006.01) |
| ***C25D 17/06*** | (2006.01) |
| ***C25D 5/02*** | (2006.01) |
| ***C25D 17/18*** | (2006.01) |
| ***C25D 7/04*** | (2006.01) |

(52) U.S. Cl.

CPC ..... *C25D 17/008* (2013.01); *C25D 5/022* (2013.01); *C25D 7/04* (2013.01); *C25D 17/007* (2013.01); *C25D 17/06* (2013.01); *C25D 17/12* (2013.01); *C25D 17/18* (2013.01)

(58) Field of Classification Search

None

See application file for complete search history.

(56) References Cited

U.S. PATENT DOCUMENTS

| | | | | |
|---|---|---|---|---|
| 2,859,157 | A * | 11/1958 | Curtiss, Jr. | C25D 7/04 205/132 |
| 3,257,308 | A * | 6/1966 | Cottom | C25D 5/02 204/297.05 |
| 3,664,944 | A * | 5/1972 | Buckley | C25D 17/06 204/288.4 |
| 7,402,231 | B2 | 7/2008 | Oikawa et al. | |
| 9,957,631 | B2 | 5/2018 | Kimoto et al. | |
| 2004/0065557 | A1 | 4/2004 | Donovan, III et al. | |
| 2010/0032291 | A1 | 2/2010 | Keller et al. | |

FOREIGN PATENT DOCUMENTS

| | | |
|---|---|---|
| CN | 102041530 B | 12/2012 |
| CN | 105803496 B | 7/2018 |
| CN | 109628969 A | 4/2019 |

* cited by examiner

*Primary Examiner* — Louis J Rufo

(74) *Attorney, Agent, or Firm* — Lorenz & Kopf, LLP

(57) ABSTRACT

Systems for masking and sealing a component for surface treatment. A system includes a pair of fixture plates disposed on opposite ends of the component from each other. One or more inner sleeves are inserted into the component to mask and seal at least a portion of the component. An outer sleeve extends between the fixture plates to seal outside of the component. A pair of fixture rods extend between the first and second fixture plates and couple the first and second fixture plates together. The system is configured to effect surface treatment of an exposed area of the component, at least a portion of the exposed area defined by and disposed adjacent to the one or more inner sleeves.

20 Claims, 4 Drawing Sheets

MASKING AND SEALING SYSTEM FOR MULTI-STEP SURFACE TREATMENT

TECHNICAL FIELD

The present invention generally relates to limiting the exposed area of a component's surface for accepting a treatment, and more particularly relates to a masking and sealing system that prevents the exposure of untreated surface areas of the component, precisely defines the exposed area to be treated, and avoids cross-contamination of solutions between treatment stages.

BACKGROUND

Many manufactured products require surface treatment such as through plating, alteration of the base material's chemical composition, coating, etching or other surface finishing. For example, a component may be constructed according to design parameters and may then be subjected to surface treatment of only a part of the component's surface, in singe-step or multi-step surface treatment processes. In multi-step processes, the component may be progressively moved from stage-to-stage and subjected to an operation that accomplishes a step or steps in the defined treatment process. When the component is submersed in a solution as part of the treatment process, the carry-over of solutions between tanks is undesirable and may require intermediate rinse steps.

Treatment processes may involve steps that alter the surface of the component, such as its material composition or finish, in ways that are undesirable for certain areas of the component. Accordingly, parts of the components may be masked to prevent exposure to the operations that effect such alteration. For example, masking is employed in material finishing operations where only a specifically defined area of the surface of the component is exposed to a process operation. Masking may involve applying a protective material such as wax, adhesive tape, paint and others. When the surface being masked is an internal component surface, accurate and repeatable application of the maskant may be difficult, leading to increased processing costs. Removal of the maskant from the component following surface treatment also leads to increased processing costs.

Accordingly, it is desirable to provide more efficient and effective systems for preparing a component for treatment of only a portion of the component's surface. Furthermore, other desirable features and characteristics of masking and sealing will become apparent from the subsequent detailed description and the appended claims, taken in conjunction with the accompanying drawings and the preceding background.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

Systems provide masking and sealing of a component for surface treatment, including in multi-step processes. In an embodiment, a system includes a pair of fixture plates disposed on opposite ends of the component from each other. One or more inner sleeves are inserted into the component to mask and seal at least a portion of the component. An outer sleeve extends between the fixture plates to seal outside of the component. At least one fixture rod extends between the fixture plates and couples the fixture plates together. The system is configured to effect surface treatment of an exposed area of the component, where at least a portion of the exposed area is defined by and is disposed adjacent to the one or more inner sleeves.

In a number of additional embodiments, a surface treatment system includes a pair of fixture plates disposed on opposite ends of the component from each other. A pair of inner sleeves are inserted into a component to mask and seal at least a portion of the component. An outer sleeve extends between the fixture plates to seal outside of the component. A pair of fixture rods extends through the fixture plates coupling them together. The system is configured for surface treatment of an exposed area of the component, with at least a portion of the exposed area disposed between the inner sleeves In a number of other embodiments, a surface treatment system includes a pair of fixture plates disposed on opposite ends of the component. A pair of inner sleeves are inserted into the component sealing a portion of the component. An anode is positioned within the component by the inner sleeves. An outer sleeve extends between the fixture plates to seal the outside the component. The system is configured to allow a fluid to circulate through the component to effect plating of an exposed area inside the component during a multi-step plating process. The exposed area is disposed between the inner sleeves and around the anode. The system is configured to maintain all surfaces of the component, except at the exposed area, in a dry state during the multi-step plating process and to allow fluid to drain from the system between steps of the multi-step plating process.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Various embodiments disclosed herein are directed to a system for defining areas of a component to be treated and for preventing cross-contamination of treatment solutions. While embodiments described herein may be disclosed in plating operations, the disclosure is not limited to plating and instead is applicable to other surface treatment processes. The system may include a pair of fixture plates disposed on opposite ends of the component to be treated. A pair of inner sleeves may be inserted into the component sealing a portion of the component. The inner sleeves may be re-useable and fabricated from a flexible or a rigid material, depending on the application. An anode may be positioned within the component by features of the inner sleeves. An outer sleeve may extend between the fixture plates to seal the outside the component, when desired. In some embodiments, hooked fixture rods may extend through the fixture plates and may be configured to conduct current to the component. The system may be configured to allow a fluid to circulate through the component to effect plating of an exposed area inside the component, where the exposed area is defined by the sleeves and around the anode. The system accurately and repeatedly defines the surface of the component to be treated to match in-service requirements, is efficiently applied and removed, and is re-useable. In addition, the system has the beneficial ability to keep all areas of the component not being plated dry.

Figure 2:
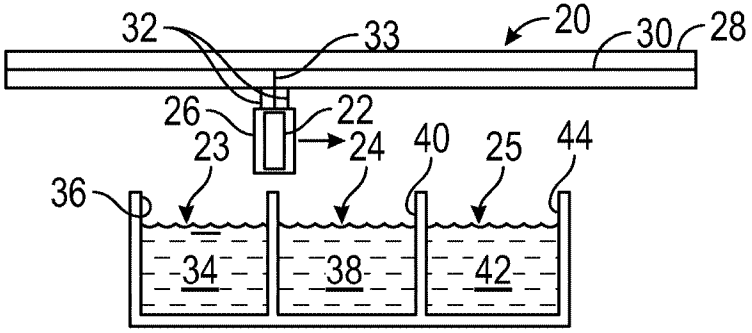
FIGS. 1-5 are schematic illustrations of an apparatus for a multi-step surface treatment process, according to an exemplary embodiment.
Figure 1:
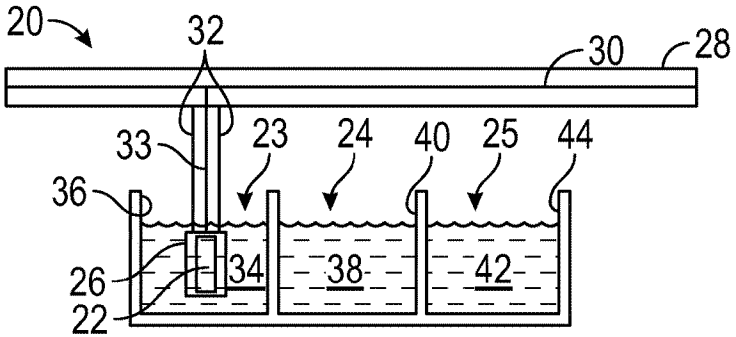

Referring to FIGS. 1-5, an apparatus 20 embodied for use with a multi-step plating process, involves the movement of a component 22 through a number of stages 23-25 to achieve a desired surface finish. In other embodiments, a different number of stages may be employed. In the current embodiment, the apparatus 20 includes a masking and sealing system 26 that carries the component 22, and that is transported by a conveyor 28. The conveyor 28 is engaged by fixture rods 32 of the system 26. The conveyor 28 includes a work bar 30 possessing separate electrical circuits for workpiece 22 and counter electrode/anode rod 33. The component 22 is assembled in the system 26, is loaded on the conveyor 28, and at the stage 23 is immersed in a solution 34 contained in a tank 36 as shown in FIG. 1. In the tank 36, the component 22 undergoes an initial treatment, which may be a pretreatment process in preparation for surface treatment finishing, or which may be a part of the surface treatment operation. In a number of embodiments, the pretreatment process may clean the component 22 in preparation for proper finishing. The solution 34 may contain one or more chemicals selected based on the material of the component 22 and the surface pretreatment desired. In a number of embodiments, the pretreatment process may involve more than one solution 34 in multiple tanks 36. The surface of the component 22 may be activated such as with an acid etch or other solution 34, in preparing its surface for finishing. The solution 34 may be of a nature that mixing with later treatment solutions is undesirable, and so the system 26 is configured to inhibit cross-contamination as further described below. When pretreatment is complete, the component 22 as carried by the system 26 is extracted from the solution 34 and transported onward by the conveyor 28 as shown in FIG. 2. In a number of embodiments, rinse tanks (not shown) and their associated process steps may be included between the process tanks 36, 40, 44, for example where removing all process solution before moving to the next process tank 36, 40, 44 is needed or preferred.

Figure 4:
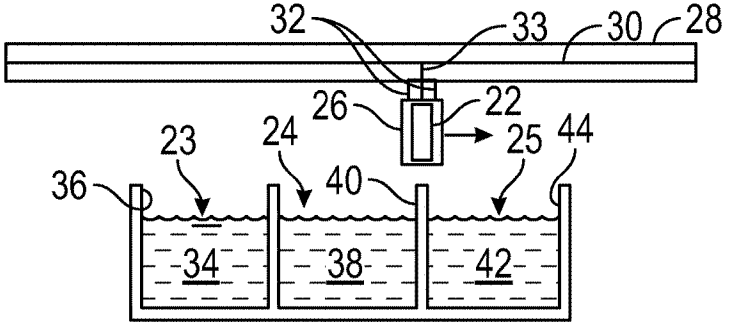
Figure 3:
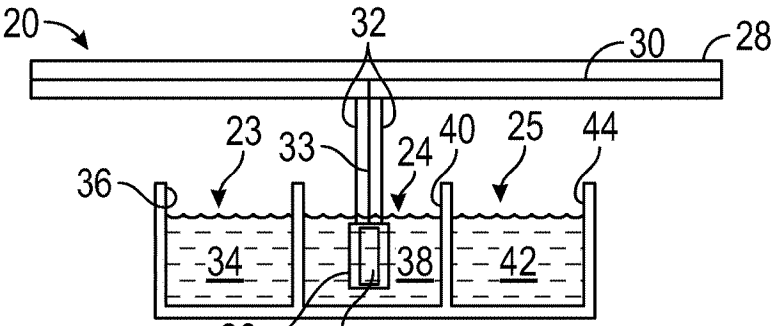

At the stage 24, the component 22 is immersed in a solution 38 contained in a tank 40 as shown in FIG. 3. In the tank 40, the component 22 may undergo a deposit of a coating material. In some embodiments, rather than a deposit of a coating material, the solution 38 may be selected to effect a change in the surface material of the component 22 itself. In the current embodiment the coating material is a plating material. Electro-deposition on component 22 may be employed, which is accomplished through work bar 30 electrical connection to component 22 and separate electrical connection to counter electrode/anode rod 33. Surface treatment may be desired on only a portion of the component 22, and so the system 26 is configured to mask and seal those areas of the component for which exposure to the solutions 34, 38, 42 is undesirable, as further described below. After treatment in the solution 38 has been completed, the component 22 as carried by the system 26 and the conveyor 28 is extracted from the solution 38 and transported onward as shown in FIG. 4.

Figure 5:
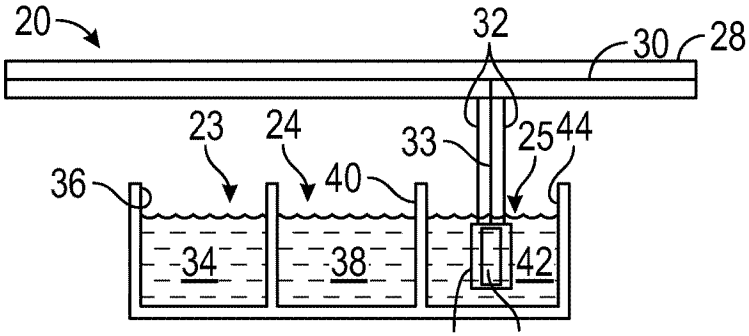

At the stage 25, the component 22 is immersed in a solution 42 in tank 44 for additional treatment as shown in FIG. 5. The solution 42 may be a further step in effectuating the surface treatment/finish desired. In some embodiments, the solution 42 may be selected to provide a post treatment to the process effected in the tank 40. For example, the solution 42 may provide passivation of the material deposited in the previous stage 24. In other embodiments, the solution 42 may provide other desirable treatment of the component 22. Following treatment in the tank 44 the component may be extracted from the system 26 and further processed as needed for the involved product and application.

Figure 6:
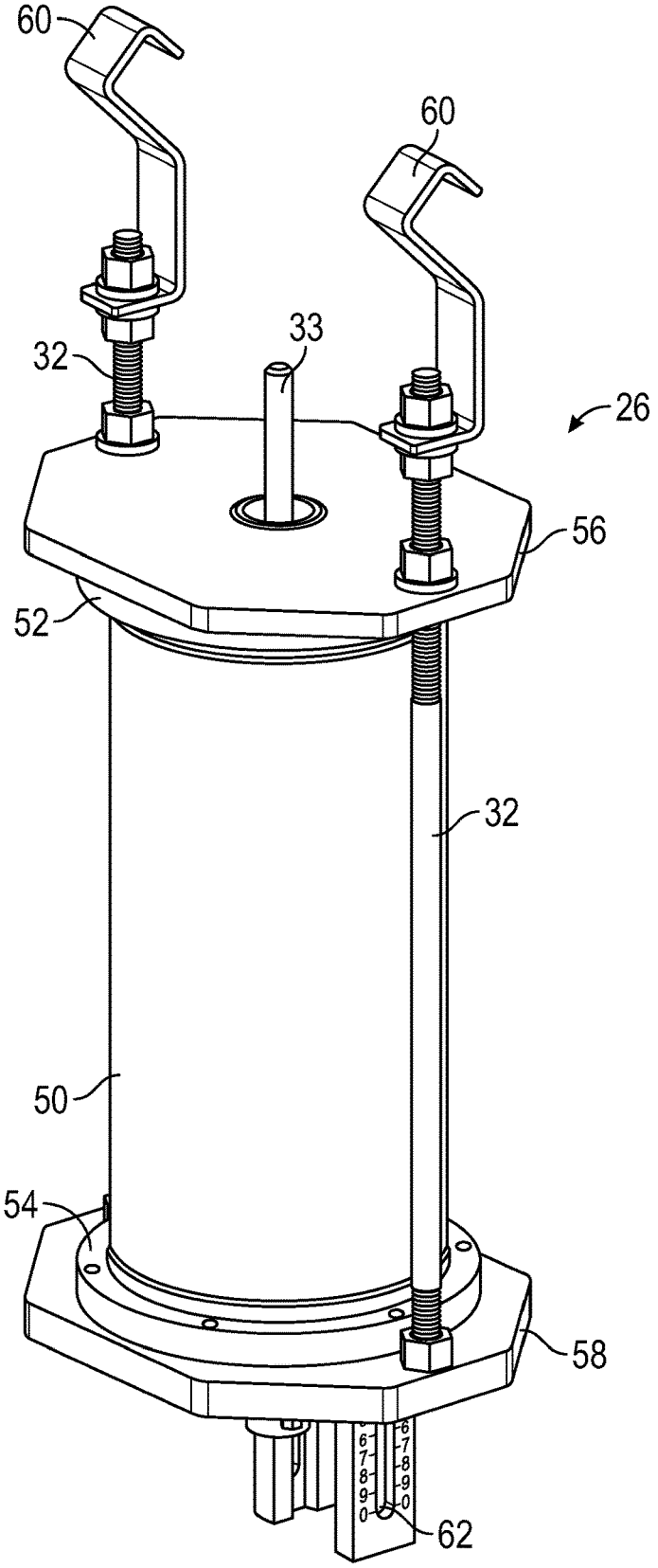
FIG. 6 is a perspective illustration of a masking and sealing system such as for use in the multi-step surface treatment process of FIGS. 1-5, according to an exemplary embodiment.

The masking and sealing system 26 comprises a fixturing system and is illustrated in greater detail in FIG. 6. The component 22 (not visible) is enclosed in an outer sleeve 50 that extends between a pair of sleeve rings 52, 54. The sleeve rings 52, 54 are held by a pair of fixture plates 56, 58 respectively, that are disposed at opposite ends of the component 22 and that are clamped together by two fixture rods 32. In some embodiments, the sleeve rings 52, 54 may be incorporated into the fixture plates 56, 58, which may enhance a leak proof system by eliminating two potential liquid pathways. Fixture hooks 60 engage the fixture rods 32 so that the system 26 may be readily loaded onto and unloaded from the conveyor 28. The anode rod 33 extends through the fixture plate 56. In the current embodiment, a bubbler 62 is carried by the fixture plate 58 to assist in generating fluid flow into and through the system 26.

Figure 7:
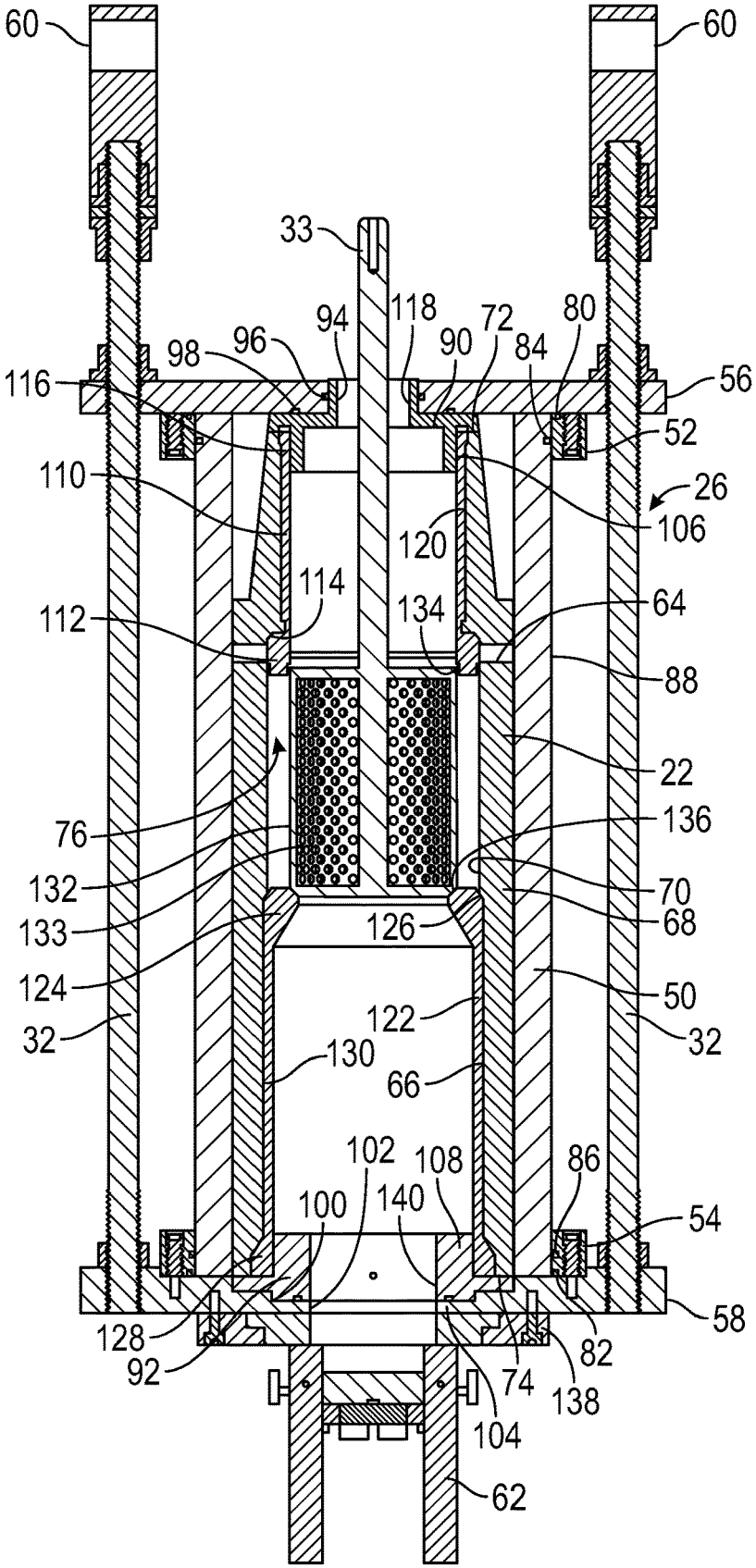
FIG. 7 is a sectional illustration of the masking and sealing system of FIG. 6, according to an exemplary embodiment.

Additional details of the system 26 are visible in the cross sectional view of FIG. 7, to which reference is directed. In this embodiment, the component 22 is generally cylindrical in shape and includes a cross bore 64 intersecting a longitudinal bore 66. The longitudinal bore 66 includes segments of various diameters including a segment 68 for which treatment of the surface 70 is desired. The surface 70 is an internal surface of the component 22 inside the longitudinal bore 66 and is spaced away from the ends 72, 74 of the component 22, making masking and treatment of the surface 70 challenging. To provide a precise definition of the treatment zone 76 at the surface 70, the system 26 provides precise masking and fluid-tight sealing of other areas of the component 22.

The component 22 fits within the outer sleeve 50 and O-rings 80, 82 are respectively provided between the fixture plates 56, 58 and the sleeve rings 52, 54. O-rings 84, 86 are provided between the sleeve rings 52, 54 and the outer sleeve 50. As a result, the component 22 is contained in a sealed environment on its outside surface 88. The component 22 is carried by the fixture plates 56, 58 via interposed end caps 90, 92. The end cap 90 fits within an opening 94 of the fixture plate 56. O-rings 96, 98 are provided between the end cap 90 and the fixture plate 56 to provide additional sealing of the outside surface 88. The end cap 92 fits within a counterbore step 100 in the fixture plate 58 that surrounds an opening 102 through the fixture plate 58. An O-ring 104 is provided between the end cap 92 and the fixture plate 58 to provide additional sealing of the outside surface 88. The end cap 90 fits against the end 72 of the component 22 and includes an extension 106 that extends into the longitudinal bore 66 from the end 72. The extension 106 biases the inner sleeve 110 against the component 22. The end cap 92 fits against the end 74 of the component 22 and includes an extension 108 that extends into the longitudinal bore 66 from the end 74. The extension 108 biases the inner sleeve 122 against the component 22.

The inside of the component 22 between the end 72 and the treatment zone 76 is sealed by the inner sleeve 110. The inner sleeve 110 is made of a flexible material such as silicone for ready insertion into the longitudinal bore 66 and to provide sealing. The inner sleeve 110 includes an annular shaped enlarged segment 112 that seals the cross bore 64 and that engages a step 114 in the longitudinal bore 66 for accurate positioning. The inner sleeve 110 includes an annular segment 116 disposed between the extension 106 and the component 22 adjacent the end 72 for improved sealing. The inner sleeve 110 is generally hollow and cylindrical in shape. The end cap 90 includes a through-hole 118 aligned with the opening 94 so that fluid may pass to the treatment zone 76 through the fixture plate 56, the end cap 90 and the inner sleeve 110, with the surface of the component 22 in the area 120 between the inner sleeve 110 and the component 22 being masked and sealed to remain fluid-tight and dry.

The inside of the component 22 between the end 74 and the treatment zone 76 is sealed by the inner sleeve 122. The inner sleeve 122 is also made of a flexible material such as silicone for ready insertion into the longitudinal bore 66 and to provide sealing. The inner sleeve 122 includes an annular shaped enlarged segment 124 that engages a step 126 in the longitudinal bore 66 for precise positioning. The inner sleeve 122 includes an annular segment 128 disposed between the extension 108 and the component 22 adjacent the end 74 for improved sealing. The inner sleeve 122 is generally hollow and cylindrical in shape. The end cap 92 includes a through-hole 140 aligned with the opening 102 so that fluid may pass to the treatment zone 76 through the fixture plate 58, the end cap 92 and the inner sleeve 122, with the surface of the component 22 in the area 130 between the inner sleeve 122 and the component 22 masked and sealed. The system 26 masks and seals all surfaces of the component 22 other than the surface 70 in the treatment zone 76.

An anode 132 is centered in the treatment zone 76 and is held in position by the inner sleeves 110, 122. In the current embodiment, the anode 132 may be an inert/insoluble anode and may be coated with a material such as mixed metal oxide, platinum on titanium. In some embodiments, the anode 132 may be soluble. The anode 132 engages in a step 134 at the enlarged segment 112 of the inner sleeve 110 and engages in a step 136 at the enlarged segment 124 of the inner sleeve 122. This locates the anode 132 at a desirable position for treatment of the surface 70. The anode rod 33 extends through the inner sleeve 110, the through-hole 118 and the opening 94. The bubbler 62 is carried on the fixture plate 58 by a mounting ring 138 and is centered with the opening 102 and the through-hole 140. The bubbler 62 assists in inducing fluid flow during treatment. The fluid generally passes through the opening 102, the through-hole 140, the inner sleeve 122, the treatment zone 76, the inner sleeve 110, the through-hole 118 and the opening 94 to circulate fluid for the treatment of the surface 70. Circulation of fluid may also be induced due to the formation of bubbles in the treatment zone 76 resulting from the treatment process. The construction also allows fluid to readily drain from the system 26 when being moved from one solution to another to prevent solution carry-over and contamination from tank to tank and to keep the areas not being treated dry during the processing. Upon completion of the treatment process, the fixture plates 56, 58 and the fixture rods 32 are unfastened and the component 22 is readily removed from the system 26. The sleeves 110, 122 are readily extracted from within the longitudinal bore 66 due to their flexible nature. For example, the inner sleeve 110 may be removed past the treated surface 70 and extracted from the end 74.

Figure 8:
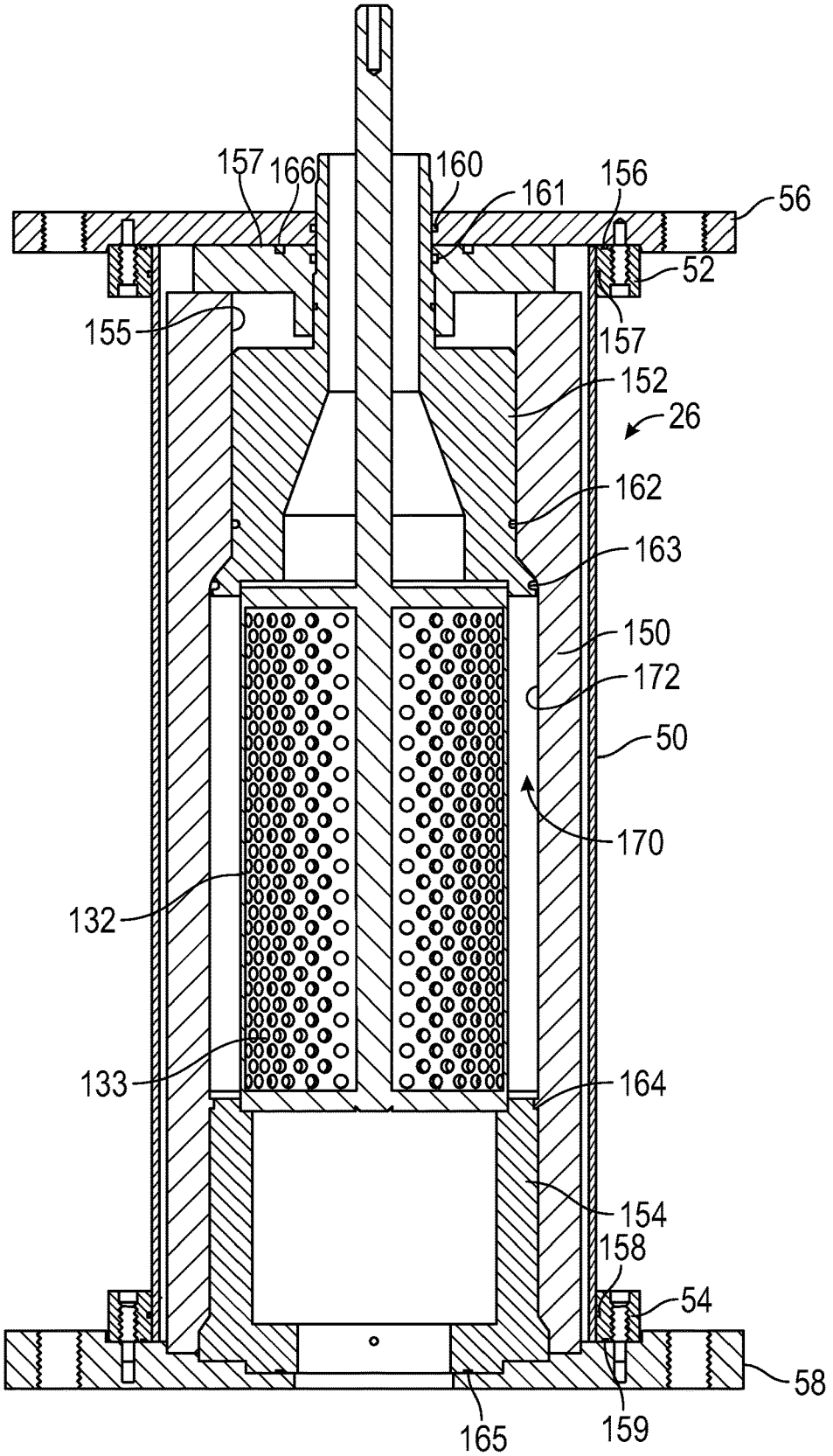
FIG. 8 is a sectional illustration of the masking and sealing system of FIG. 6 with an alternative sleeve arrangement, according to an exemplary embodiment.

An alternate inner sleeve approach is illustrated in the embodiment of FIG. 8, where the fixture rods 32 and the bubbler 62 are omitted for simplicity. In this example, the component 150 is amenable to the use of rigid inner sleeves 152, 154 in the masking and sealing system 26, due to the shape of the longitudinal bore 155. The fixture plates 56, 58, the sleeve rings 52, 54 and the outer sleeve 150 include O-rings 156-159 at their respective interfaces for sealing. Additional O-rings 160-166 are provided at interfaces with the inner sleeves 152, 154 for sealing purposes given the rigid nature of the inner sleeves 152, 154, including at the end cap 157 and the fixture plates 56, 58. The inner sleeve 152 carries the O-rings 162, 163 and the inner sleeve 154 carries the O-rings 164, 165. The inner sleeves 152, 154 accurately define the treatment zone 170, which is on the surface 172 of the component 150, and all of its other surfaces of the component 150 are masked and sealed by the system 26. In this embodiment, the rigid nature of the inner sleeve 154 allows omitting an end cap adjacent the fixture plate 58. The sleeves 152, 154 engage and position the anode 132 and surface treatment solutions are allowed to circulate through the system 26 and the treatment zone 170.

Through the foregoing embodiments, a treatment zone is precisely defined, and non-treated surfaces are masked and sealed to remain dry during processing. The system allows fluid to readily circulate to the treatment zone and to readily drain to prevent entrapment and cross contamination. The use of inner sleeves facilitates precise and repeatable definition of the surface(s) to be treated. The system provides a cost effective, efficient approach to masking and is readily removed after treatment. The system supports the use of surface treatment processes that have multiple steps such as nickel plating of hard to mask locations.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A system for surface treatment of a component with a bore, the system comprising:

a fixture system configured to carry the component during the surface treatment, including first and second fixture plates disposed on opposite ends of the component from each other;

an inner sleeve inserted into the bore of the component to mask and seal at least a portion of the component inside the bore, the inner sleeve comprising a first end and a second end, the second end extending into the bore further than the first end;

an anode engaging the inner sleeve at the second end and extending further into the bore than the second end, the anode fixed in position within the component by engaging the inner sleeve;

an outer sleeve extending between the fixture plates to seal outside of the component; and at least one fixture rod extending between the first and second fixture plates and coupling the first and second fixture plates together, wherein the system is configured to effect surface treatment of an exposed area of the component, at least a portion of the exposed area disposed adjacent the at least one inner sleeve.

2. The system of claim 1, comprising a first sleeve ring disposed at the first fixture plate and a second sleeve ring disposed at the second end ring, wherein the outer sleeve extends inside the first and second sleeve rings to seal the outside of the component.

3. The system of claim 1, wherein the component includes an internal surface defining the bore, the exposed area comprising a treatment zone on the internal surface facing the anode, with the anode extending longitudinally through the bore a length corresponding with the treatment zone and longitudinally centered in the treatment zone.

4. The system of claim 1, wherein the at least one fixture rod is configured to conduct current and is electrically coupled with the component through the first and second fixture plates.

5. The system of claim 4, comprising a conveyor configured to move the fixture system through plural treatment stages, wherein the conveyor includes an electrical work bar, wherein the at least one fixture rod and the anode are coupled with the electrical work bar of the conveyor.

6. The system of claim 1, comprising an end cap, wherein the end cap is coupled between the first fixture plate and the inner sleeve and the end cap includes an extension extending into the inner sleeve and biasing the inner sleeve against the component.

7. The system of claim 6, comprising an end cap disposed between the first fixture plate and the inner sleeve, wherein:

the inner sleeve comprises a hollow shape, the first and second fixture plates each define an opening, the end cap defines a through-hole;

a bubbler carried on the second fixture plate and centered with both the opening of the second fixture plate and the through-hole, wherein the bubbler is configured to induce fluid flow through the treatment zone during immersion treatment, and the system is configured, assisted by the bubbler, to allow a fluid to circulate through the component and to pass through the inner sleeve, through the openings of the first and second fixture plates and through the through-hole.

8. The system of claim 1, wherein the first fixture plate defines an opening, wherein the anode includes an anode rod that extends through the opening of the first fixture plate, wherein the inner sleeve includes an enlarged segment at the second end with a step formed at the enlarged segment, wherein the anode engages in the step and inside the enlarged segment of the inner sleeve.

9. The system of claim 1, comprising an end cap disposed between the first fixture plate and the inner sleeve, the end cap disposed against one of the opposite ends of the component, wherein the end cap includes an extension that extends into the bore from the one of the opposite ends.

10. The system of claim 9, wherein the inner sleeve includes an annular segment disposed between the extension of the end cap and the component and adjacent the first end for sealing between the end cap and the component.

11. A system for surface treatment of a component with a bore, the system comprising:

a fixture system configured to carry the component during the surface treatment, including first and second fixture plates disposed on opposite ends of the component from each other;

first and second inner sleeves inserted into the bore of the component to mask and seal at least a portion of the component inside the bore, the first inner sleeve including a first end and a second end, the second end extending into the bore further than the first end, and the second inner sleeve including a third end and a fourth end, the fourth end extending into the bore further than the third end;

an anode engaging the first inner sleeve at the second end and engaging the second inner sleeve at the fourth end, the anode extending through the bore between the first and second inner sleeves, the anode fixed in position within the component by engaging the first and second inner sleeves;

an outer sleeve extending between the fixture plates to seal outside of the component; and a pair of fixture rods extending through the first and second fixture plates and coupling the first and second fixture plates together, wherein the system is configured to effect surface treatment of an exposed area of the component, at least a portion of the exposed area disposed between the first and second inner sleeves.

12. The system of claim 11, comprising a first sleeve ring disposed at the first fixture plate and a second sleeve ring disposed at the second end ring, wherein the outer sleeve extends inside the first and second sleeve rings to seal the outside of the component.

13. The system of claim 11, wherein the component includes an internal surface defining the bore, the exposed area comprising a treatment zone on the internal surface that faces the anode, wherein the anode is non-soluble, with the anode extending longitudinally through the bore a length corresponding with the treatment zone and longitudinally centered in the treatment zone.

14. The system of claim 11, wherein the fixture rods are configured to conduct current and are electrically coupled with the component through the first and second fixture plates.

15. The system of claim 14, comprising a hook on each of the first and second fixture rods, the hooks configured to couple with a conveyor.

16. The system of claim 11, comprising an end cap, wherein the end cap is coupled between the first fixture plate and the first inner sleeve, the end cap including an extension and the first inner sleeve including an annular segment disposed between the extension and the component, the extension extending into the first inner sleeve and configured to bias the annular segment against the component.

17. The system of claim 11, comprising an end cap disposed between the first fixture plate and the first inner sleeve, wherein:

the first and second inner sleeves each comprises a hollow shape, the first and second fixture plates each defines an opening, the end cap defines a through-hole, a bubbler is carried on the second fixture plate and centered with both the opening of the second fixture plate and the through-hole, wherein the bubbler is configured to induce fluid flow through the treatment zone during immersion treatment, and the system is configured to allow a fluid to circulate, assisted by the bubbler, through the component and to pass through the first and second inner sleeves, through the openings of the first and second fixture plates, and through the through-hole.

18. The system of claim 11, wherein the first fixture plate defines an opening, wherein the anode includes an anode rod that extends through the opening of the first fixture plate, wherein the first inner sleeve includes a first enlarged segment at the second end with a first step formed at the first enlarged segment, wherein the anode engages in the first step and inside the first enlarged segment of the first inner sleeve, wherein the second inner sleeve includes a second enlarged segment at the fourth end with a second step formed at the second enlarged segment, wherein the anode engages in the second step and inside the second enlarged segment of the second inner sleeve.

19. The system of claim 11, comprising an end cap disposed between the first fixture plate and the inner sleeve, the end cap disposed against the component, wherein the end cap includes an extension that extends into the bore.

20. A system for surface treatment of a component with a bore where the surface treatment is effected in a treatment zone in the bore, the system comprising:

a fixture system configured to carry the component during the surface treatment, including a pair of fixture plates disposed on opposite ends of the component, wherein the opposite ends include a first end and a second end;

a pair of inner sleeves inserted into the component sealing a portion of the component, the pair of inner sleeves including a first inner sleeve extending into the bore from the first end to a first point along the bore and a second inner sleeve extending into the bore from the second end to a second point along the bore;

an anode positioned within the component by the inner sleeves, the anode engaging the first and second inner sleeves and disposed in the bore between the first and second points along the bore so that the anode faces the treatment zone; and an outer sleeve extending between the fixture plates to seal outside the component;

wherein the system is configured to allow a fluid to circulate through the component to effect plating of an exposed area inside the component during a multi-step plating process, the exposed area disposed between the inner sleeves and around the anode, the system configured to maintain all surfaces of the component, except at the exposed area, in a dry state during the multi-step plating process and to allow fluid to drain from the system between steps of the multi-step plating process.

* * * * *